US005345642A

United States Patent [19]

Faldetta

[11] Patent Number: 5,345,642

[45] Date of Patent: Sep. 13, 1994

[54] DUAL SIZED C-SHAPED SCRAPER FOR CYLINDRICAL CONTAINERS

[76] Inventor: John Faldetta, 415 E. 54th St., Apt. 2E, New York, N.Y. 10022

[21] Appl. No.: 163,045

[22] Filed: Dec. 6, 1993

[51] Int. Cl.[5] ..... A47L 13/08

[52] U.S. Cl. ..... 15/105; 15/236.05; 294/55

[58] Field of Search ..... 15/105, 236.05, 236.01; 294/55

[56] References Cited

U.S. PATENT DOCUMENTS

| | | | |
|---|---|---|---|
| 745,679 | 12/1903 | Schulze | 15/236.05 |
| 1,434,744 | 11/1922 | Hibbler | 15/236.05 X |
| 1,883,726 | 10/1932 | Warren | 15/105 X |
| 2,068,046 | 1/1937 | Yardlay | 294/55 |
| 2,646,581 | 7/1953 | Nelson | 15/105 X |
| 2,828,502 | 4/1958 | Tupper | 15/236.05 X |
| 2,944,275 | 7/1960 | Markusen | 15/236.01 |
| 4,381,576 | 5/1983 | Nishikawa | 15/105 X |
| 4,627,128 | 12/1986 | Shea | 15/236 R |
| 4,674,186 | 6/1987 | Galiano | 30/169 |
| 4,686,734 | 8/1987 | Kahan | 294/55 X |
| 4,987,635 | 1/1991 | Young | 15/236.01 |

FOREIGN PATENT DOCUMENTS

| | | | |
|---|---|---|---|
| 78858 | 8/1955 | Netherlands | 15/236.05 |

*Primary Examiner*—Chris K. Moore
*Attorney, Agent, or Firm*—Steven Horowitz

[57] ABSTRACT

A hand tool for removing adhesive material, such as ceramics, from cylindrical containers and/or scraping such containers clean of residual adhesive material, thereby salvaging such material and reducing the labor and material costs of construction work, includes a handle and two different sized blade members of semi-cylindrical shape. The dual size feature makes the tool suitable for a range of container sizes, especially one gallon and one quart containers. The absence of a bottom surface connected to the blade members enhances the efficiency of the tool. By one or two simple hand rotations of the tool while the appropriate blade member is inside the container, virtually all of the adhesive material can be removed. The length of the blade members, their placement with respect to one another and the placement of an angulated rod connecting the blade members to the handle make use of the tool simple and effective.

18 Claims, 2 Drawing Sheets

FIG. 3
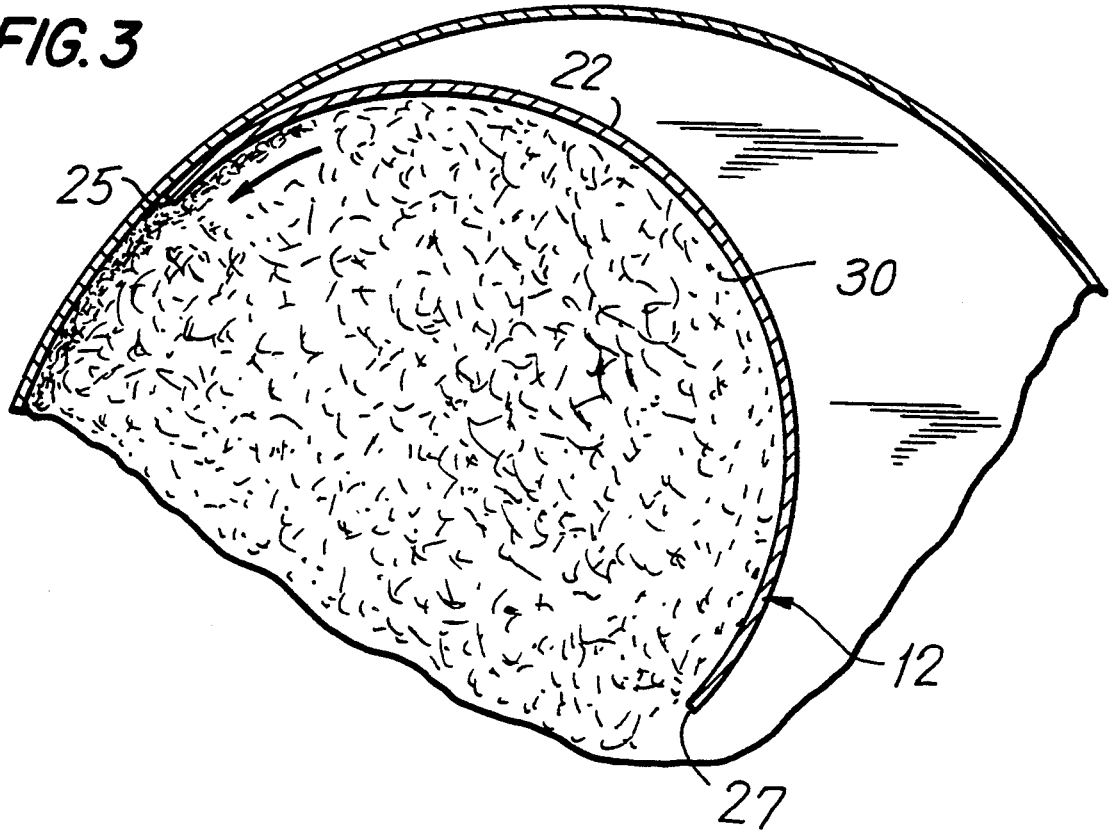
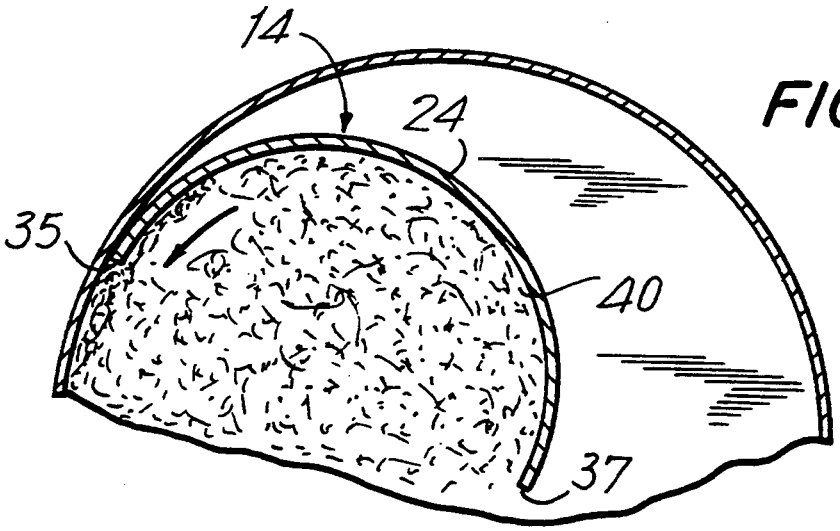
FIG. 4

DUAL SIZED C-SHAPED SCRAPER FOR CYLINDRICAL CONTAINERS

BACKGROUND OF THE INVENTION

This invention pertains to a tool for removing adhesive material from cylindrical containers and cleaning such containers of residual adhesive material, thereby salvaging such material and reducing the labor and material costs of construction work.

DESCRIPTION OF THE PRIOR ART

Adhesives of all kinds are commonly used in the construction industry. Common examples are ceramics, floor mastics and sheet rock compounds. Typically, these materials are applied to a floor other part of a building by manually removing the contents of the adhesive from a cylindrical container with a hand tool and applying the adhesive to the floor. Such removal requires repetitively scooping out the adhesive and applying it to the floor in successive acts. Ordinarily, only 80 to 85% of the contents of the cylindrical container can be removed since the tool can not sufficiently access all of the adhesive in the container. The remainder has to be discarded, thus increasing the cost of materials.

Devices that are presently known have attempted to solve the problem of removing the residual amounts of adhesive materials from large cylindrical containers. Typical examples of prior art tools that attempt to do this are U.S. Pat. No. 4,627,128 to Shea, issued on Dec. 9, 1986 and U.S. Pat. No. 4,987,635 to Young, issued on Jan. 29, 1991.

These and other known devices typically utilize a handle connected to a curved blade member that conforms to the interior walls and bottom of the cylindrical containers. Such known devices are not capable of removing the residual material easily and effectively without getting stuck or bound to the adhesive material. One reason is that these devices are constructed so that the length of the blade member conforms too perfectly to the depth of the interior walls of the container. The result is too tight a fit between the blade member and the interior walls of the container. This increases the resistance encountered when the user tries to rotate the tool while it is within the interior of the container.

A second reason that some of the known devices of this type are unable to effectively salvage residual adhesive from the container in one or two simple rotating motions is that they are constructed with a bottom extending perpendicularly from the blade of the tool. The half moon bottom of the blade member makes it impossible for all of the adhesive in the container to be automatically forced upward when the tool is rotated by hand inside the container. This bottom feature also reduces the capacity of these devices to remove adhesives from full containers by obstructing the tool from reaching the bottom of the container in one simple motion.

Furthermore, all of these known devices are effectively limited in application to a single size container since they are constructed with a single blade member. Use of such tools in containers significantly larger than the size of its blade member greatly reduces their ability to remove the adhesive material in one or two simple rotations of the hand. Moreover, use of such a tool in containers smaller than the size of its blade member is simply impossible.

In addition, the known devices that are specifically designed to clean residual material from cylindrical containers are not well suited to removing adhesives from full containers. Conversely, the devices that are used for scooping out adhesives from full containers are not well suited for scraping or cleaning the residual material from containers to salvage the remaining adhesive.

SUMMARY OF THE PRESENT INVENTION

The present invention overcomes the disadvantages of the prior art by providing a tool that is easily adaptable to more than one size container and that has the additional advantage of being able to remove all adhesive materials inside a cylindrical container swiftly and easily in one or two rotations of the hand without getting stuck.

A further object of the present invention is to provide a hand tool that is both well suited for cleaning residual adhesive material from the sides and bottom of containers as well as for removing adhesives from containers full of material.

Another object of the present invention is to provide a hand tool for handling, cleaning and removing adhesives from containers that is constructed in the simplest and most economical manner.

When the present invention, nicknamed the Duo C Scraper, is placed inside a container full of adhesives and the wooden handle is rotated by hand so that the blade member inside the container scrapes the interior walls of the container, the adhesive material is drawn away from the walls of the container and into the semicylindrical area within the blade member. Simultaneously, the adhesive nature of the material forces the adhesive material on the bottom of the container into the semicylindrical area of the blade member. The result is that 98 to 99% of the adhesives materials contained in the container is removed from the container in one or two simple rotations of the hand.

The present invention consists of a hand-held tool having one small and one large blade member at opposite ends of the tool. Each end of an angulated metal rod is welded or otherwise attached to the back surface of each of the two blade members and also runs through the interior of a wooden handle located at the middle of the tool. The handle is situated so that the blade members extend longitudinally from the two ends of the handle in such a way that the small blade member, the handle and the large blade member are connected in substantially one straight line. The large and small blade members are positioned so that one is attached to the metal rod at a 180 degree revolution interval from the another blade member in order to prevent the user's hand holding the wooden handle while in use from being pinched by the blade member that is not in contact with the container.

When in use, a side edge of the larger blade member scrapes the interior walls of a container that holds one gallon of adhesive material, producing a squeegee effect. Alternatively, a side edge of the smaller blade member scrapes the interior walls of a container that holds a quart of adhesive material and produces a squeegee effect. The length of each blade member is designed so that it is slightly shorter than the depth of the container containing the adhesive material it is used in (the depth being measured from the bottom of the rim of the container to the inside bottom of the container), thus permitting smooth rotation of the tool inside the container without getting stuck. In particular, the length of the large blade member should be 6 and ¾ to 6 and 13/16 inches to make it ideally suited for use in one gallon containers and for use in larger containers. The length of the small blade member should be 4 and ¼ inches to make it ideally suited for use in quart containers and for use in containers larger than a quart but smaller than a gallon.

A metal rod welded or otherwise attached to the back surface of each blade member is attached via bolts to the wooden handle. In the preferred embodiment, the metal rod extends through the interior cavity of the wooden handle. The wooden handle is offset from the blade members by the angular nature of the metal rod, thus avoiding adhesive material coming into contact with the user's hand.

The shape and construction of the present invention thus facilitates removal of residual adhesive material in one or two swift and easy rotations of the hand by scraping the interior walls of the container. As the blade travels along the interior walls of the container the adhesive material moves from the side wall and accumulates within the semicylindrical area delineated by the shape of the blade member. The lack of a bottom or end member to the tool simultaneously allows adhesive on the bottom of the container to be forced into the same semicylindrical area of the blade member in the same motion.

Other objects, features and advantages of the present invention will be apparent from the following detailed description taken in connection with the accompanying drawings.

BRIEF DESCRIPTION OF THE DRAWINGS

The present invention will be more fully understood by reference to the following detailed description of a preferred embodiment of the present invention when read in conjunction with the accompanying drawings, in which like reference characters refer to like parts throughout the views and in which:

FIG. 3 is a horizontal cross-sectional view taken generally along lines 3—3 of FIG. 1; and FIG. 4 is a view similar to FIG. 3 but showing the small end of the tool employed with a small container.

DETAILED DESCRIPTION OF THE DRAWINGS

Figure 1:
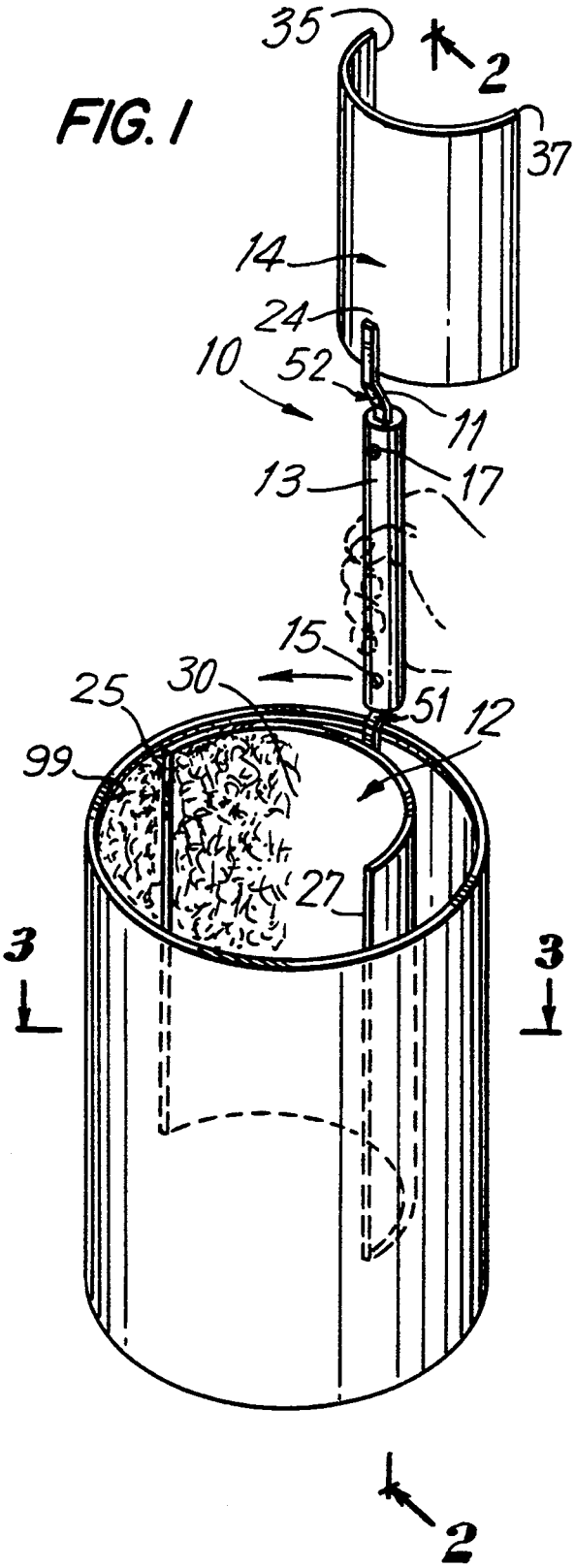
FIG. 1 is a top, front and side perspective view of the tool of the present invention shown in use.
Figure 2:
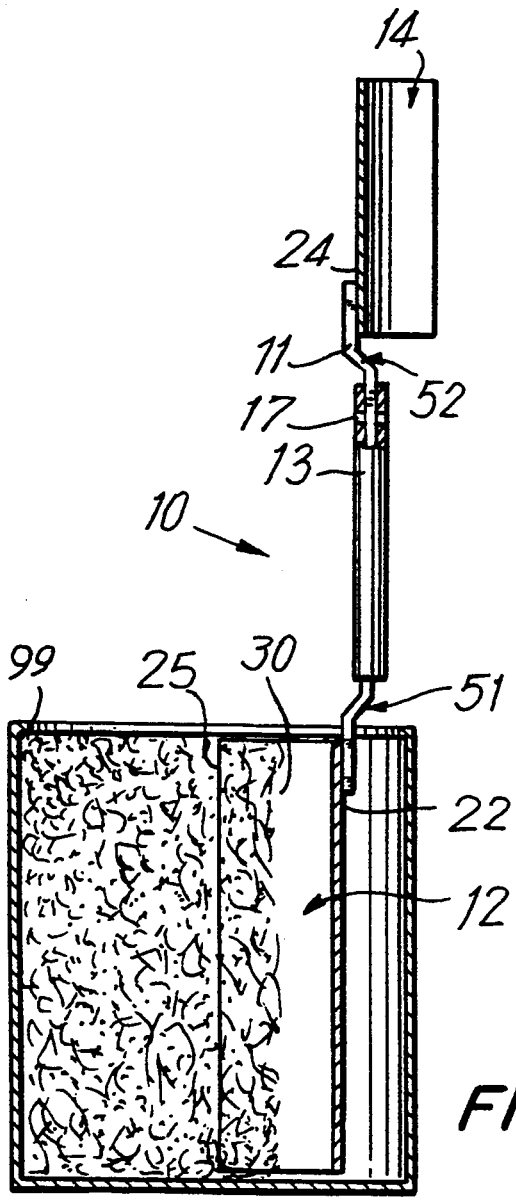
FIG. 2 is a vertical cross-sectional view taken generally along lines 2—2 of FIG. 1.

Referring generally to FIGS. 1 through 4, there is shown a tool 10 embodying the present invention for removing adhesives from and for cleaning the interior walls of one gallon and quart containers as well as containers holding more than a gallon. The materials the tool is made from can be varied depending on the precise application intended. In the preferred embodiment, the entire large blade member 12 and the entire small blade member 14 are constructed separately by bending a uniform sheet of twenty gauge galvanized steel into a semi-circle. Ideally, the large blade member 12 is six and three quarters to six and thirteen sixteenths inches long and has a semi-circular circumference of four inches. Ideally, the small blade member 14 is four and one quarter inches long and has a semi-circular circumference of two and thirteen sixteenths inches. As seen in FIG. 2, these lengths are designed to leave a one quarter inch discrepancy between the length of the corresponding blade member and the depth of the gallon or quart container, the container being shorter by one quarter inch, thus permitting the rotation of the blade member inside the container to effectuate scraping the wall of the container without significant resistance. In this regard, as seen in FIG. 2, the depth of the container is calculated from the interior bottom of the container to the lowest point 99 of the container's rim.

FIG. 2 also illustrates with respect to use of the large blade member that the rod 11 extends one quarter inch above the blade member before it turns at a forty-five degree angle and begins area 51 (which is the portion of the rod between the two bend points on that side of the handle). This provides leeway so that blade member 12 can reach the bottom of the container and be rotated without the rod interfering with the top of the container. As seen in FIG. 2, similar leeway is provided between the small blade member 14 and the rod 11 before the first turn (going in the direction from the small blade member to the handle) beginning area 52.

Each end of an angulated metal rod 11 is welded or otherwise attached to the corresponding back sides 22, 24 of each of the blade members. The rod is also attached to the elongated wooden handle 13. In the preferred embodiment depicted in FIGS. 1 and 2, the rod 11 extends through the interior of and is bolted to the elongated wooden handle 13 by means of bolts 15, 17. It can easily be envisioned that in various alternative constructions, two recesses at the ends of the handle would be used instead of a cavity running through the entire length of the handle and two shorter angulated rods would be used instead of one and would be attached and bolted to the handle at these recesses. The metal rod 11 is bent at forty-five degree angles at four points, two on each side of the handle, defining areas 51, 52 so that the handle is offset from the large blade member 12, as seen in FIG. 2.

The tool of this invention is particularly useful in the construction industry for handling, removing and cleaning all kinds of adhesives and other compounds from cylindrical containers.

The following is a brief summary of the manner of operation and usage of the tool 10, as seen in FIGS. 1–3. When the Duo C Scraper tool 10 is placed inside a gallon container full of adhesives, the wooden handle 13 held by the user's hand is rotated so that one of the side edges 25, 27 of the large blade member 12 scrapes the interior walls of the container. As a result, the adhesive material moves from the walls of the container into the semicylindrical area 30 encompassed by the large blade member. Simultaneously, the adhesive nature of the material also forces the adhesive material on the bottom of the container into the semicylindrical area 30 of the blade member. The adhesive material is finally removed from the container when the tool is removed from the inside of the container. The result is that 98 to 99% of the adhesives materials is removed from the container in one or two swift and easy rotations of the hand grasping the tool inside the container.

As seen by further reference to FIG. 4, the same manner of usage is applicable to the one quart container except that in that. case the small blade member 14 is inserted into such a container and one of the side edges 35, 37 of the small blade member scrapes the interior wall of the container creating a squeegee effect. In this scenario, as seen in FIG. 4, adhesive material moves to the semicylindrical area 40 encompassed by the small blade member.

Alternatively, the tool 10 container be used to clean a container that is not full and only contains residual adhesive material. By doing so, the user salvages the fifteen to twenty percent of the contents of the container that would otherwise remain. In this scenario, the manner of operation is the same as above except that the rotating motion requires less force.

It is to be understood that the above-described embodiments are simply illustrative of the principles of the invention. It is to be understood also that various other modifications and changes may be devised by those skilled in the art which will embody the principles of the invention and fall within the spirit and scope thereof. It is not desired to limit the invention to the exact construction and operation shown and described.

What is claimed is:

1. A new and improved hand tool for removing the contents of and for scraping clean a cylindrical container for adhesive materials, said tool comprising:

an elongated handle;

a large blade member having a substantially semicylindrical curvature connected to one end of an angulated rod and extending generally longitudinally therefrom and from the elongated handle;

a small blade member having a substantially semicylindrical curvature connected to a second end of said angulated rod and extending generally longitudinally therefrom and from the elongated handle; and an angulated rod whose opposite ends are attached to a back surface of each said blade member and which is attached to said elongated handle.

2. The tool of claim 1, wherein said small blade member is positioned at a 180 degree revolution interval from said large blade member.

3. The tool of claim 1, wherein the length of said large blade member is six and three quarters to six and thirteen sixteenths.

4. The tool of claim 1, wherein the length of said small blade member is approximately four and one quarter inches.

5. The tool of claim 1, wherein the blade members are constructed by bending a sheet of galvanized steel into a substantially semicylindrical curvature.

6. The tool of claim 5, wherein said galvanized steel is twenty gauge in thickness.

7. The tool of claim 1, wherein said elongated handle is made of wood.

8. The tool of claim 1, wherein said angulated rod is made of metal.

9. The tool of claim 1, wherein said angulated rod is welded to said blade members.

10. A new and improved hand tool for removing the contents of and for scraping clean a cylindrical container for adhesive materials, said tool comprising:

an elongated handle;

a large blade member having a substantially semicylindrical curvature connected to one end of an angulated rod and extending generally longitudinally therefrom and from the elongated handle;

a small blade member having a substantially semicylindrical curvature connected to a second end of said angulated rod and extending generally longitudinally therefrom and from the elongated handle; and an angulated rod whose opposite ends are attached to a back surface of each said blade member and which extends through the interior of said elongated handle.

11. The tool of claim 10, wherein said small blade member is positioned at a 180 degree revolution interval from said large blade member.

12. The tool of claim 10, wherein the length of said large blade member is six and three quarters to six and thirteen sixteenths.

13. The tool of claim 10, wherein the length of said small blade member is approximately four and one quarter inches.

14. The tool of claim 10, wherein the blade members are constructed by bending a sheet of galvanized steel into a substantially semicylindrical curvature.

15. The tool of claim 14, wherein said galvanized steel is twenty gauge in thickness.

16. The tool of claim 10, wherein said elongated handle is made of wood.

17. The tool of claim 1, wherein said angulated rod is made of metal.

18. The tool of claim 1, wherein said angulated rod is welded to said blade members.

* * * * *